US008020698B2

(12) United States Patent
Gelardi

(10) Patent No.: US 8,020,698 B2
(45) Date of Patent: Sep. 20, 2011

(54) PRODUCT PACKAGING SYSTEMS AND METHODS

(75) Inventor: John A. Gelardi, Wake Forest, NC (US)

(73) Assignee: Atlas AGI Holdings, LLC, Greenwich, CT (US)

( * ) Notice: Subject to any disclaimer, the term of this patent is extended or adjusted under 35 U.S.C. 154(b) by 621 days.

(21) Appl. No.: 12/161,687

(22) PCT Filed: Jan. 19, 2007

(86) PCT No.: PCT/US2007/001559

§ 371 (c)(1),
(2), (4) Date: Jul. 21, 2008

(87) PCT Pub. No.: WO2007/084733

PCT Pub. Date: Jul. 26, 2007

(65) Prior Publication Data

US 2010/0224633 A1 Sep. 9, 2010

Related U.S. Application Data

(60) Provisional application No. 60/760,722, filed on Jan. 20, 2006.

(51) Int. Cl.
*B65D 85/14* (2006.01)

(52) U.S. Cl. ..... 206/277; 206/776; 220/8; 220/324; 229/125.17; 229/125.125; 229/125.32

(58) Field of Classification Search ..... 206/277, 206/485, 467, 776; 220/8, 23.83, 315, 324, 220/495.05, 495.06; 229/125.17, 125.19, 229/125.125, 125.32
See application file for complete search history.

(56) References Cited

U.S. PATENT DOCUMENTS

| | | | | |
|---|---|---|---|---|
| 1,951,831 | A * | 3/1934 | Lewis | 206/277 |
| 4,042,105 | A | 8/1977 | Taylor | |
| 4,128,168 | A * | 12/1978 | Roccaforte | 206/783 |
| 6,112,893 | A * | 9/2000 | Aubry et al. | 206/277 |
| 6,899,246 | B2 | 5/2005 | Gehring | |
| 7,000,775 | B2 * | 2/2006 | Gelardi et al. | 206/776 |
| 7,374,048 | B2 * | 5/2008 | Mazurek | 206/776 |
| 7,882,953 | B2 * | 2/2011 | Heller et al. | 220/8 |
| 2003/0132158 | A1 | 7/2003 | Clausen et al. | |
| 2004/0031807 | A1 * | 2/2004 | Chou | 220/786 |
| 2005/0247578 | A1 | 11/2005 | Gelardi et al. | |
| 2008/0011637 | A1 * | 1/2008 | Young et al. | 206/467 |

* cited by examiner

*Primary Examiner* — Luan K Bui
(74) *Attorney, Agent, or Firm* — Pillsbury Winthrop Shaw Pittman LLP

(57) ABSTRACT

Disclosed is a product package which includes a packaging sleeve and a product container. The packaging sleeve has a first end that defines an opening and a closed second end. The sleeve includes at least one pair of locking tabs projecting from the first end, each locking tab including a locking edge and each locking tab being folded inwards into the opening. The product container has a body portion for receiving the product and a rigid end cap which sealingly engages with the body portion so as to house the product. The end cap is dimensioned to fit closely within the opening of the sleeve and includes a peripheral rim that, when the end cap is inserted into the sleeve opening, engages the sleeve end and prevents the end cap from being inserted further into the opening.

34 Claims, 12 Drawing Sheets

250
256
254
252
260
258
256

250
254
252
260
258

270
272
274
276
278

PRODUCT PACKAGING SYSTEMS AND METHODS

This application is a 371 of PCT/US07/01559, filed on Jan. 19, 2007 which claims benefit of Provisional Application No. 60/760,722, filed on Jan. 20, 2006.

BACKGROUND OF THE INVENTION

1. Field of the Invention

The presently disclosed embodiments are directed towards the field of product packaging, and in particular to product packaging which utilizes a portion of the product container as an end cap for the packaging.

2. Background of the Related Art

Product packaging serves a number of different functions, including: protecting the packaged product from accidental damage, attractively displaying the packaged product, providing descriptive and nutritional information and preventing theft or tampering. It is desirable however for a product package to be as inexpensive to manufacture as possible. On such improved package design is described in U.S. Pat. No. 7,000,775 to Gelardi et. al, the disclosure of which is herein incorporated by reference in its entirety.

However, there is an ongoing need in the packaging industry for new package designs which can be more readily manufactured and require less material than conventional packaging and also provide tamper resistant features.

SUMMARY OF THE INVENTION

Disclosed is a product package which includes, inter alia, a packaging sleeve and a product container. The packaging sleeve has a first end that defines an opening and a closed second end. The sleeve includes at least one locking tab projecting from the first end, each of the locking tabs including a locking edge and is folded inwards into the sleeve opening.

The product container includes a body portion that defines an interior chamber for housing a consumable product and a rigid end cap which sealingly engages with the body portion so as to seal the product within the interior chamber. The end cap is dimensioned to fit closely within the opening of the sleeve and includes a peripheral rim that, when the end cap is inserted into the sleeve opening, engages the sleeve end and prevents the end cap from being inserted further into the opening. The end cap also has at least one channel for receiving the locking tabs, each channel having a ledge that engages the locking edge of each locking tab to prevent the end cap and product from being removed from the sleeve. In a preferred embodiment, the end cap includes a mechanism for releasably engaging with the body portion of the product container. In certain constructions, the end cap includes a series of threads for engaging with corresponding threads formed on the body portion of the product container. However, those skilled in the art will readily appreciate that other mechanism can be used for securing the end cap to the body portion of the product.

In a preferred embodiment, each locking tab is trapezoidal and has an acute vertex that rides up a side edge of the locking tab's receiving channel when the product end cap is twisted relative to the sleeve, such that the end cap is released from the sleeve. However, in certain constructions of the disclosed product package, each of the channels has at least one ramped side edge, such that when the end cap is twisted relative to the sleeve, each locking tab rides up the ramped side edge of the locking tab's receiving channel, such that the end cap is released from the sleeve.

It is also envisioned that in certain embodiments, the second end of the sleeve includes a cavity shaped to receive an end of the product container.

It is presently envisioned that in preferred embodiments the sleeve and locking tabs have a strength and resilience that combines with the dimensioning and angling of the ledges to produce a firm locking action when the locking tabs are engaged by the ledges. Moreover, each of the locking tabs and the channels are shaped such that the end cap is twistable to a position in which the locking tabs are clear of the ledges, thereby releasing the end cap from the sleeve.

In a preferred embodiment, the product container is adapted for storing toothpaste.

Also disclosed herein is a product package that includes, among other elements, a sleeve and a product. The packing sleeve has at least one end that defines an opening and at least one pair of locking tabs extending therefrom. Each locking tab includes a locking edge and is folded inwards into the sleeve opening.

The product includes a body portion and an end cap which is engaged with the body portion. The body portion of the product is adapted and configured for insertion into the sleeve and the end cap is dimensioned to fit closely within the sleeve opening. Additionally, the end cap includes a rim that, when the end cap is inserted into the opening, engages the sleeve end and prevents the end cap from being inserted further into the opening. The end cap also includes a pair of channels for receiving the pair of locking tabs, each channel having a Ledge that is dimensioned and angled to engage the locking edge of each locking tab to prevent the end cap from being removed from the sleeve opening.

In certain preferred embodiments, each of the locking tabs is trapezoidal and has an acute vertex that rides up a side edge of the locking tab's receiving channel when the product end cap is twisted relative to the sleeve, such that the product end cap is released from the sleeve. Moreover, in certain constructions, each of the channels has at least one ramped side edge, such that when the product end cap is twisted relative to the sleeve, each locking tab rides up the ramped side edge of the locking tab's receiving channel, such that the product end cap is released from the sleeve.

In alternative constructions of the presently disclosed product package, the sleeve includes a second end that defines a second opening, and wherein a second pair of locking tabs extend from the second end and are folded inward into the second opening. Each of the second pair of locking tabs has a locking edge. A second end cap is dimensioned to fit closely within the second opening. This end cap may or may not be associated with the product. The second end cap includes a rim that, when the second end cap is inserted into the second opening, engages the second sleeve end and prevents the second end cap from being inserted further into the second opening. The second end cap also includes a channel for receiving the second pair of locking tabs, the channel having a ledge that engages the locking edge of each of the second pair of locking tabs to prevent the second end cap from being removed from the second sleeve opening.

In certain constructions, the second end cap includes a cavity shaped to receive a second end of the product. Preferably, the end cap includes means for engaging with the body portion of the product. For example, the end cap can include a series of threads for engaging with corresponding threads formed on the body portion of the product.

It is envisioned that in preferred embodiments, the sleeve and locking tabs have a strength and resilience that combines with the dimensioning and angling of the ledges to produce a firm locking action when the locking tabs are engaged by the ledges. In these constructions, each of the locking tabs and the channels are shaped such that the end cap is twistable to a position in which the locking tabs are clear of the ledges, thereby releasing the end cap from the sleeve.

The present invention is also directed to product packages which include an elongated sleeve and a product container. The elongated sleeve defines an opening at one end thereof which is bounded by a peripheral edge. The sleeve includes a pair of opposed resilient locking tabs that extend from the peripheral edge of the opening and are adapted for releasably engaging an end cap received within the opening.

The product container which includes a body portion having an interior chamber for housing a product and a rigid end cap which sealingly engages with the body portion so as to seal the product within the interior chamber. The end cap is adapted and configured for reception within the opening of the sleeve. Moreover, the end cap has a base portion that is dimensioned and configured to extend into the sleeve and a peripheral wall. The peripheral wall of the end cap extends upwardly from the base portion and has an outwardly extending rim that is adapted to abut the peripheral edge of the sleeve opening to limit the extent to which the base portion can extend into the sleeve. The opposed resilient locking tabs are dimensioned and configured to releasably engage the peripheral wall of the end cap to prevent removal of the end cap from the sleeve.

In a preferred embodiment, the opposed resilient locking tabs are dimensioned and configured to releasably engage an exterior surface of the peripheral wall of the end cap. In certain constructions, the opposed locking tabs are adapted and configured for folding into the sleeve to releasably engage the peripheral wall of the end cap of the product container.

Preferably, the sleeve is defined by opposed first and second curved panels. It is envisioned that, the first and second curved panels are connected to one another along lateral edges of the sleeve. In certain embodiments, the first and second curved panels are integrally joined to one another along a first lateral edge of the sleeve. Moreover, the first and second curved panels can be affixed to one another along a second lateral edge of the sleeve.

Preferably, the product end cap includes a mechanism for engaging with the body portion of the product. For example, the product end cap can include a series of threads for engaging with corresponding threads formed on the body portion of the product.

Preferably, the sleeve and locking tabs have a strength and resilience that combines with the dimensioning and angling of the ledges to produce a firm locking action when the locking tabs are engaged by the ledges. Moreover, each of the locking tabs and the channels are shaped such that the end cap is twistable to a position in which the locking tabs are clear of the ledges, thereby releasing the product end cap from the sleeve.

In certain preferred constructions of the present invention, the sleeve defines a second opening at a second end thereof which includes a second peripheral edge. Additionally, the sleeve includes a second pair of opposed resilient locking tabs extending from the second peripheral edge of the second opening for releasably engaging a second end cap received within the second opening. The product package would include a second end cap that is adapted and configured for reception within the second opening of the sleeve. The end cap can include features similar to those previously described above.

BRIEF DESCRIPTION OF THE DRAWINGS

The presently disclosed embodiments will be further explained with reference to the attached drawings, wherein like structures are referred to by like numerals throughout the several views. The drawings are not necessarily to scale, the emphasis having instead been generally placed upon illustrating the principles of the presently disclosed embodiments.

So that those having ordinary skill in the art will better understand how to make and use the subject invention, embodiments thereof will be described below with reference to the drawings wherein:

FIG. 3B is a side elevational view of the end cap; FIG. 3C is a cross-sectional view of the end cap; FIG. 3D is a side elevational view of the end cap; FIG. 3E is a side view of the end cap (dashed lines illustrate the interior of the end cap); FIG. 3F is a perspective looking at the interior of the end cap which illustrates the screw means; and FIG. 3G is a perspective view of the top of the end cap;

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION OF PREFERRED EMBODIMENTS

Reference is now made to the accompanying figures for the purpose of describing, in detail, preferred and exemplary embodiments of the present disclosure. The figures and detailed description are provided to describe and illustrate examples in which the disclosed subject matter may be made and used, and are not intended to limit the scope thereof.

Figure 1:
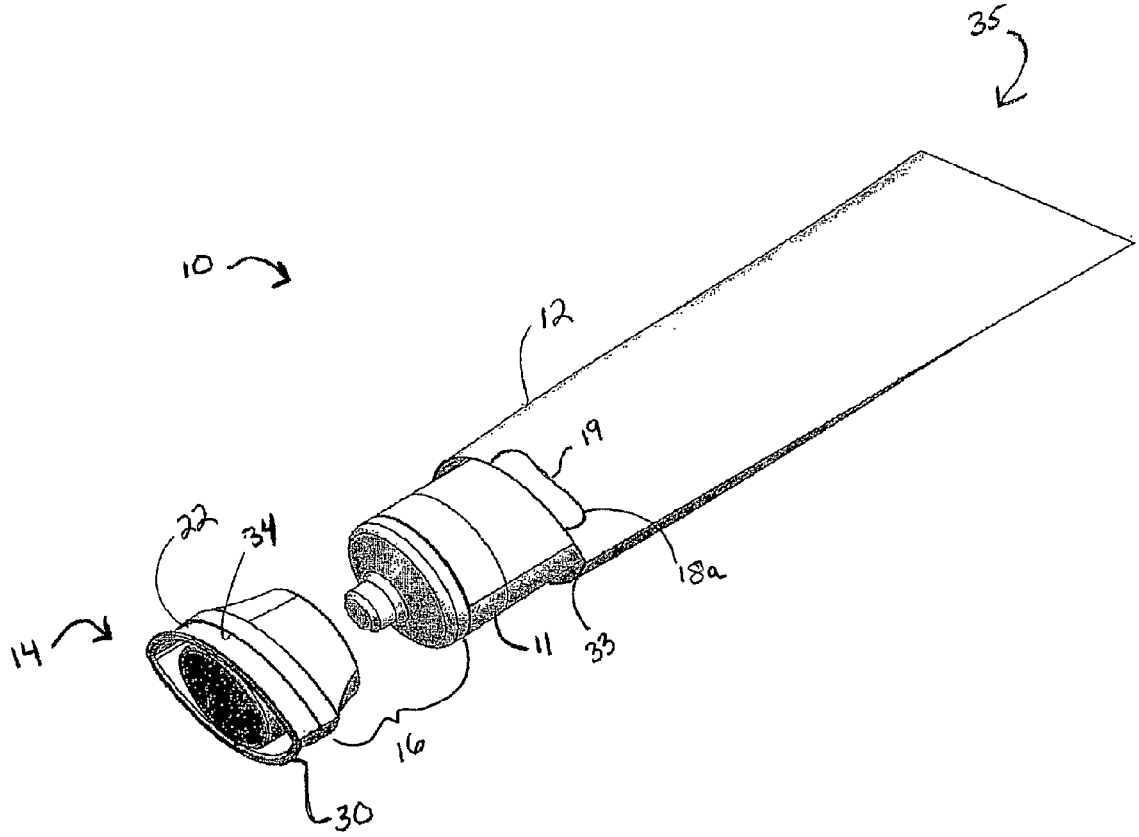
FIG. 1 is a perspective view of an embodiment of a presently disclosed product packing wherein the end cap is disengaged from the packaging sleeve and product container.
Figure 2:
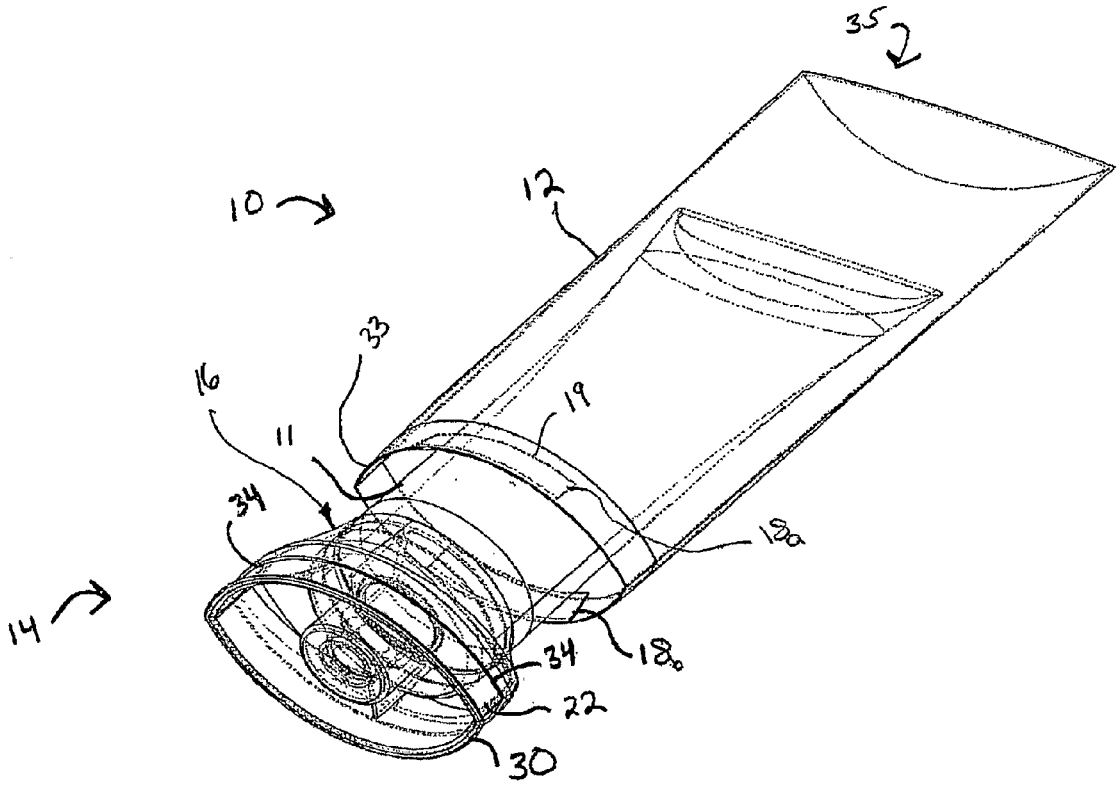
FIG. 2 is a perspective view of the product packaging of FIG. 1 wherein the product container is shown partially inserted within the packaging sleeve and dashed lines illustrate the interior of the end cap and sleeve.
Figure 3B:
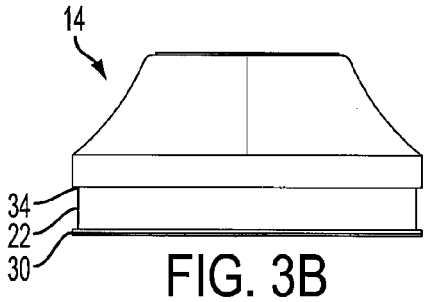
FIGS. 3A-3G provide several views of an embodiment of a presently disclosed end cap, wherein 3A is a bottom view of the end cap.
Figure 3C:
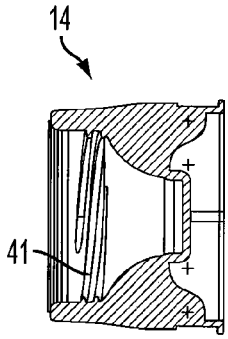
Figure 3A:
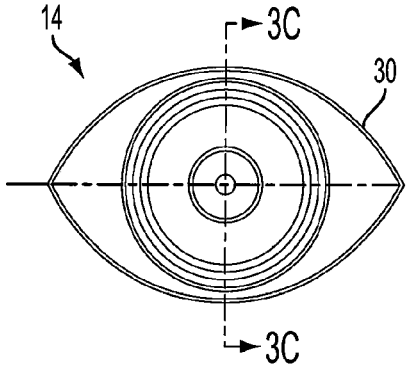
Figure 3D:
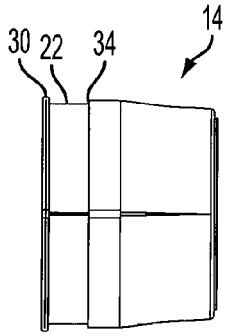
Figure 3E:
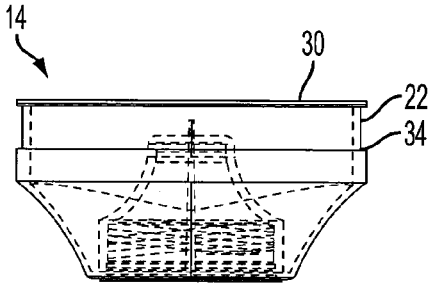
Figure 3F:
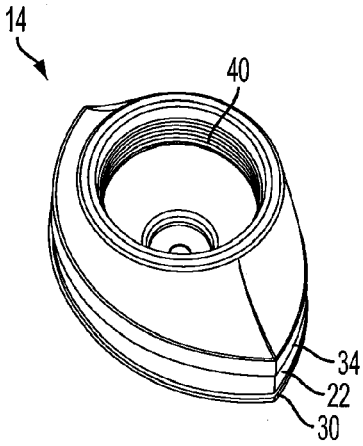
Figure 3G:
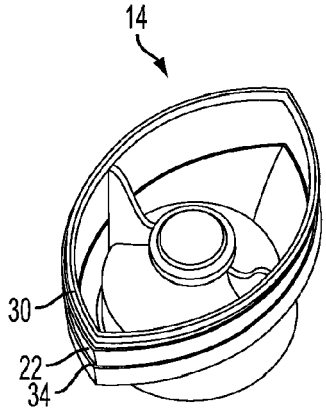

Referring now to the accompanying figures, there is illustrated in FIGS. 1 and 2 a product package constructed in accordance with a preferred embodiment of the present invention which has been designated generally by reference numeral 10. As shown, the product package 10 comprises sleeve 12 and a product container 16. The packaging sleeve 12 has a first end 33 that defines an opening and a closed second end 35. The sleeve 12 includes a pair of locking tabs 18*a* and 18*b* projecting from the first end 33, each locking tab 18*a*/18*b* including a locking edge 19 and each locking tab being folded inwards into the sleeve opening. The product container 16 has a body portion 11 for receiving a product and a rigid end cap 14 which sealingly engages with the body portion 11 so as to form a housing for the product. The end cap 14 is dimensioned to fit closely within the opening of the sleeve 12 and includes a peripheral rim 30 that, when the end cap 14 is inserted into the sleeve opening, engages the sleeve end 33 and prevents the end cap 14 from being inserted further into the opening. As will be described hereinbelow, the end cap 14 also includes a channel 22 for receiving the pair of locking tabs 18*a*/18*b*, the channel 22 having a ledge 34 that engages the locking edge 19 of each locking tab 18*a*/18*b* to prevent the end cap 14 and container body portion 11 from being removed from the sleeve 12.

As shown, container 16 is in the form of a typical tooth paste container which is composed of a tube and an end cap. The end cap can be, for example, the screw-off type or it can include flip-top portion that is connected to the base of the cap with a living hinge. However, those skilled in the art will readily appreciate that the present invention is not limited to applications such as tooth paste packages or use with products provided in containers formed from a tube and a cap. It is envisioned that other products can be packaged in accordance with the teachings of the present disclosure.

Sleeve 12 is manufactured from a continuous sheet of material and has a distal end 35 which is closed. The sleeve 12 may suitably be fabricated from a sheet of see-through plastic material, such as PVC, APET, PETG, Polylactic Acid (PLA) or the like. The thickness of the sheet is selected based on a number of factors, including price and strength. The sheet should be thick enough to provide structural support, but thin enough to allow the sheet to be flexed and folded, as described herein. Product related information may also be printed on the sleeve material.

As shown in FIG. 3, the interior of the end cap 14 can include a screw threads 41 which are adapted to engage with complementary screw threads formed on the end of the product container body 11.

Referring again to FIG. 2, which illustrates the insertion of a product container 16 into the packaging sleeve 12. As shown, a first locking tab 18*a* is positioned on a first side of the sleeve 12 and a second locking tab 18*b* is positioned on a second side of the sleeve 12. As the product container 16 is inserted into the sleeve 12, the first locking tab 18*a* and the second locking tab 18*b* each enter the channel 22 of the end cap 14. Once the locking tabs 18*a*/18*b* are positioned in the channel 22, the locking tabs engage ledge 34 of channel 22 and the end cap 14 may only be removed from the sleeve 12 by tearing or cutting the sleeve 12. It should be noted that in certain embodiments, the end cap 14 is secured to the sleeve 12 using a releasable locking mechanism. As described below, to create a releasable locking mechanism the single continuous channel can be replaced with separate, circumferentially spaced-apart channels for each locking tab. In such embodiments the end cap 14 is released by twisting the end cap 14 within the sleeve 12 such that the lateral edges of the channels force the respective locking tab radially outward thereby releasing the end cap.

Those skilled in the art will recognize than any number of locking tabs located in any orientation along a proximal end of the sleeve are within the spirit and scope of the present invention.

FIG. 3A-FIG. 3G show various views of an embodiment of a presently disclosed end cap 14. As shown, the end cap 14 includes a rim 30 which allows for a user to grip the end cap 14 and also prevents the end cap from being inserted too far into the sleeve 12. End cap 14 also includes a channel 22 for engaging locking tabs 18*a*/18*b* of the sleeve 12, and a ledge 34 which interacts with the locking tabs 18*a*/18*b* of the sleeve and prevents the end cap from being withdrawn from the sleeve opening.

The end cap 14 also includes a screw means 41 which engages with corresponding screw means formed on an end of the product container body 11. Typically, the product container body 11 is engaged to the end cap 14 prior to securing the end cap 14 to the sleeve 12. Such a configuration allows for increased product stability and an optimization of sleeve material.

Figure 4:
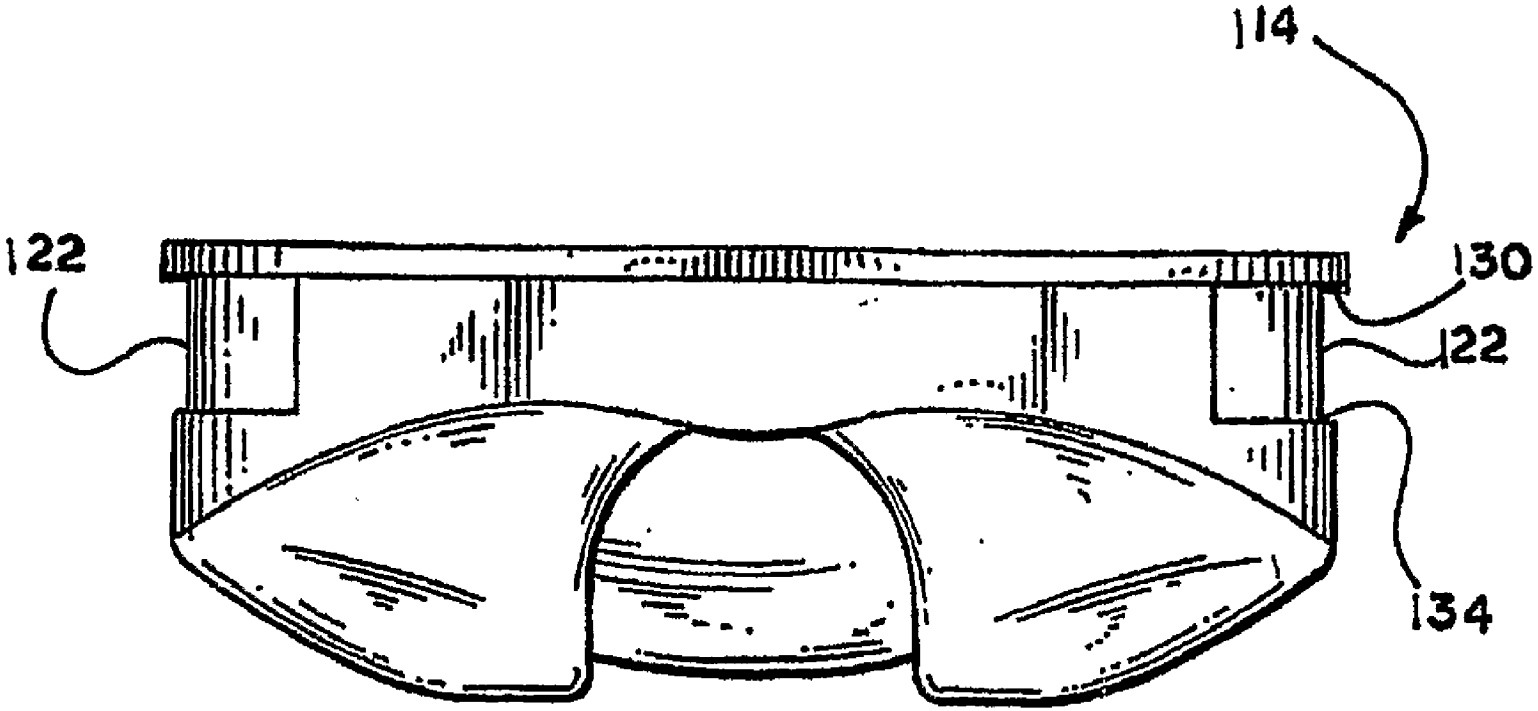
FIG. 4 provides an elevation view of an alternative embodiment of a presently disclosed end cap.

FIG. 4 shows an elevation view of an alternative embodiment of the presently disclosed end cap 114. The end cap 114 is a rigid body that may suitably be fabricated, for example, using an injection molding technique. Suitable materials for the end caps include PVC, polypropylene, polyethylene, and polystyrene.

The end cap 114 shown in FIG. 4, as mentioned above, provides a releasable locking mechanism for securing the end cap 114 to a packaging sleeve. The releasable locking mechanism includes a pair of rectangular channels 122 on opposite sides of the end cap 114. The channels 122 are positioned to receive a corresponding pair of locking tabs, such as tabs 18, extending from a packaging sleeve. As before, the upper side of each channel 122 is defined by a rim 130 that is dimensioned to be slightly larger than the upper opening of the sleeve 12, and to engage the upper sleeve end to prevent the end cap 114 from being inserted too far into the sleeve opening. The lower side of each channel 122 is defined by a ledge 134, which provides a surface for engaging a locking edge of each locking tab 18.

Figure 5:
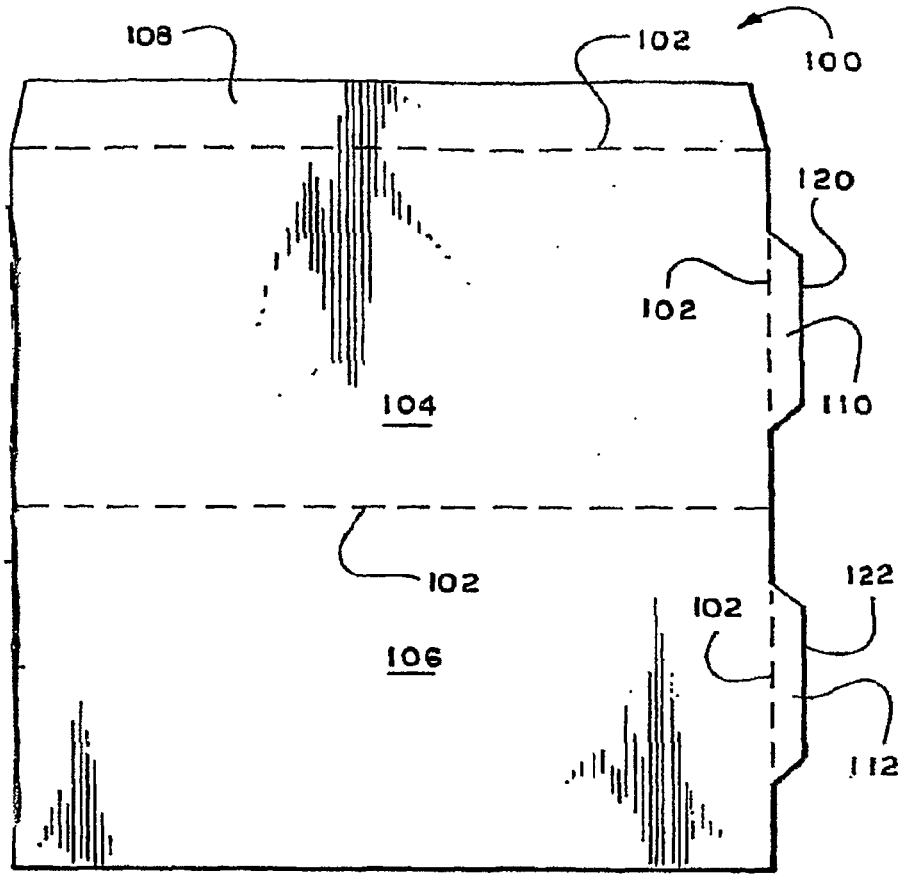
FIG. 5 is a plan view of a blank for fabricating a packaging sleeve according to a presently disclosed embodiment.

The operation of the locking and release mechanisms is now described with respect to an exemplary container and exemplary fabrication technique. It will be apparent that the described container and fabrication technique may be modified without departing from the spirit of the invention. FIG. 5 shows a plan view of a blank 100 for forming a sleeve according to a presently disclosed embodiment. The blank 100 is die cut from a sheet of suitable material, such as PVC, APET, PLA or PETG. Those skilled in the art will recognize that various other materials are within the spirit and scope of the present invention. If desired, textual or graphic matter may be printed directly onto the blank using a high-speed printing process.

A series of score lines 102 are fabricated into the blank 100 to divide the blank into a number of panels and tabs. The blank 100 includes a first panel 104 and a second panel 106 that are folded towards each other to form the body of the finished sleeve. A glue flap 108 extends upward from the first panel 104, opposite the second panel 106, and is used to attach the outside edges of the first and second panels 104 and 106 to each other.

Extending from the right side of each of the first and second panels 104 and 106 is a releasable locking tab 110 and 112. According to an aspect of the invention, the releasable locking tabs 110 and 112 are trapezoidal in shape. As discussed below, other shapes may be used for the releasable locking tabs 110 and 112.

Each of the locking tabs 110, 112 includes a respective locking edge 120 and 122 that, as described below, engages a ledge in an end cap, such as ledge 156 in end cap 150 illustrated in FIGS. 8A-D and described below, to lock the end caps in position in the sleeve ends. It will be seen that when the second panel 106 is folded over the first panel 104, locking tab 112 will line up with locking tab 110. However, other orientations for the locking tabs 110, 112, may also be used without departing from the spirit of the invention.

Figure 6:
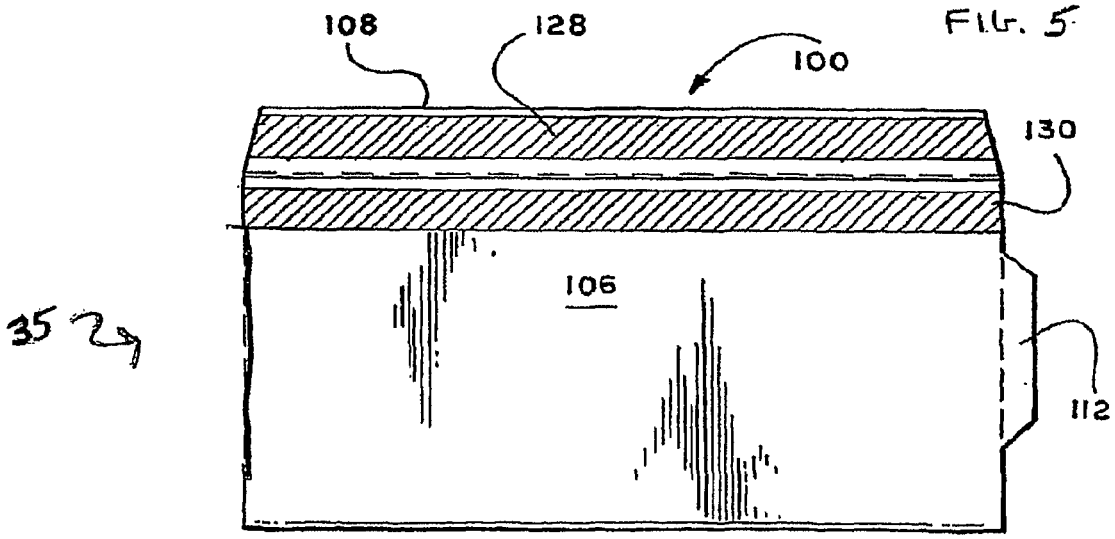
FIG. 6 is a plan view of the blank of FIG. 5, partially fabricated into a sleeve according to a presently disclosed embodiment.

In fabricating a finished sleeve from the blank 100, the second panel 106 is folded over the first panel 104. The partially folded blank 100 is shown in FIG. 6. The glue flap 108 is then folded over the second panel 106, and a suitable technique is employed to cause the glue flap 108 to adhere to the second panel 106 at the cross-hatched regions 128 and 130. It will be seen that the bonding of the glue flap 108 to the second panel 106 creates a tube with openings at the left and right of the blank 100. In addition, a suitable technique will be used to seal the distal end (left side) of the sleeve 35. Those skilled in the art will appreciate that various techniques to seal the distal end of the container are within the spirit and scope of the present invention.

Figure 7A:
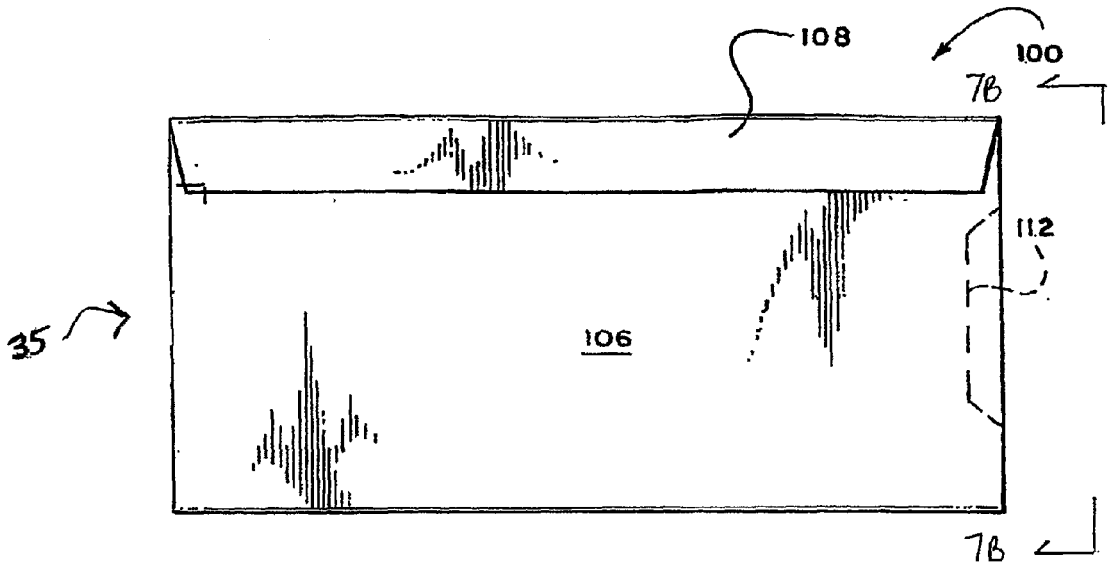
FIG. 7A is a plan view of the blank shown in FIG. 5, fully assembled into a sleeve according to a presently disclosed embodiment.
Figure 7B:
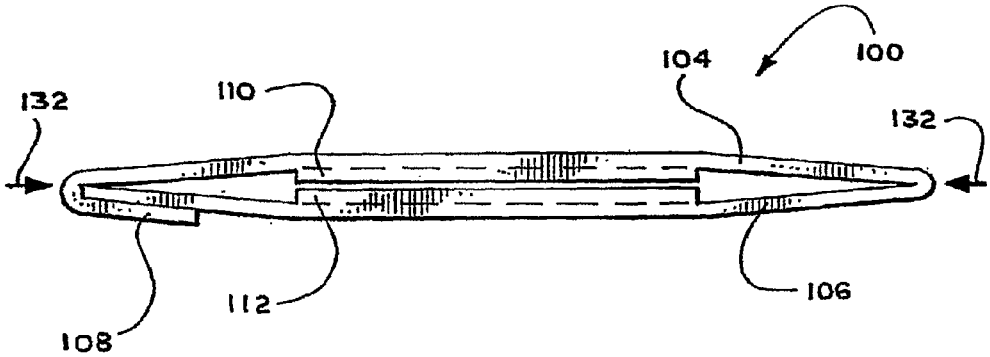
FIG. 7B is a side view of the blank shown in FIG. 7A.

Prior to the attachment of the end cap, the locking tabs 110 and 112 are folded inward towards the interior of the sleeve. FIG. 7A shows a plan view of the finished sleeve 100, and FIG. 7B, not drawn to scale, shows a right side view of the sleeve 100. The sleeve 100 may be readily popped open at the open end for insertion of the end cap by applying gentle pressure to the sleeve in the direction of the arrows 132 shown in FIG. 7B.

Depending on the dimensions of the finished sleeve 100, it would be possible for a worker to hold the sleeve 100 in one hand, using the thumb and fingers to apply pressure to the side edges of the sleeve 100. The worker could then pop the sleeve 100 open at the open end, and use the other hand to install the product container with end cap into the sleeve opening. Once the end cap has been installed, the package is relatively stable, and can be stood on end, with the installed end cap acting as a base.

Once the package has been loaded and closed, it would still be possible to adjust or rework the contents of the package by using the twist-off release mechanism described below to remove the releasable end cap without damaging the sleeve.

FIGS. 8A-D are cross section diagrams of an exemplary product end cap 150 and sleeve end 170 illustrating the operation of a locking mechanism according to a presently disclosed embodiment. The drawing of sleeve end 170 includes a broken line 172, which represents the perimeter of the sleeve opening.

As described above, the sleeve end 170 includes a pair of locking tabs 174. The locking tabs 174 extend upward from the sleeve 176. Prior to the installation of the end cap 150, the locking tabs 174 are folded into the sleeve opening, towards the inner surface of the sleeve 176. However, because of the resilience of the material used to fabricate the sleeve 176 and locking tabs 174, the locking tabs 174 have tendency to unfold slightly. The slight unfolding of the locking tabs 174 has been exaggerated in FIGS. 8A-D for purposes of illustration. The unfolding of the locking tabs 174 is useful in ensuring a firm locking action.

The locking cap 150 includes a channel 152 at each side corresponding in position to the locking tabs 174. The channels 152 are not drawn to scale. In a releasable end cap, separate channels are provided, corresponding in position to each of the locking tabs 174.

The upper boundary of the channel 152 is defined by a rim 154 that, when the end cap 150 is seated in the sleeve end 170, overhangs the sleeve end 170 to prevent the end cap 150 from being further inserted into the sleeve end. The channel 152 further includes a ledge 156 that engages a locking edge of each of the locking tabs 174. Although the channel 152 is shown as having a rectangular profile, other channel profiles may also be used. For example, it may be desirable for the ledge to define a more acute angle, or for the channel to be deeper. The ledge face 158 is dimensioned and shaped to fit closely within the sleeve.

Figure 8A:
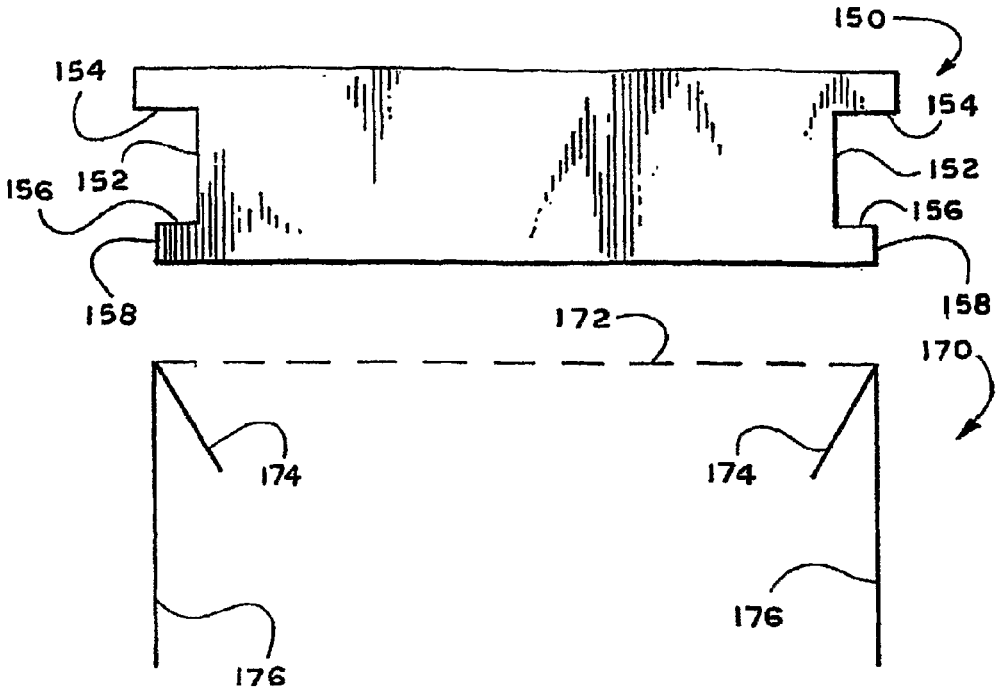
FIGS. 8A-8D show a series of diagrams illustrating the operation of the end cap retaining mechanism according to a presently disclosed embodiment.
Figure 8B:
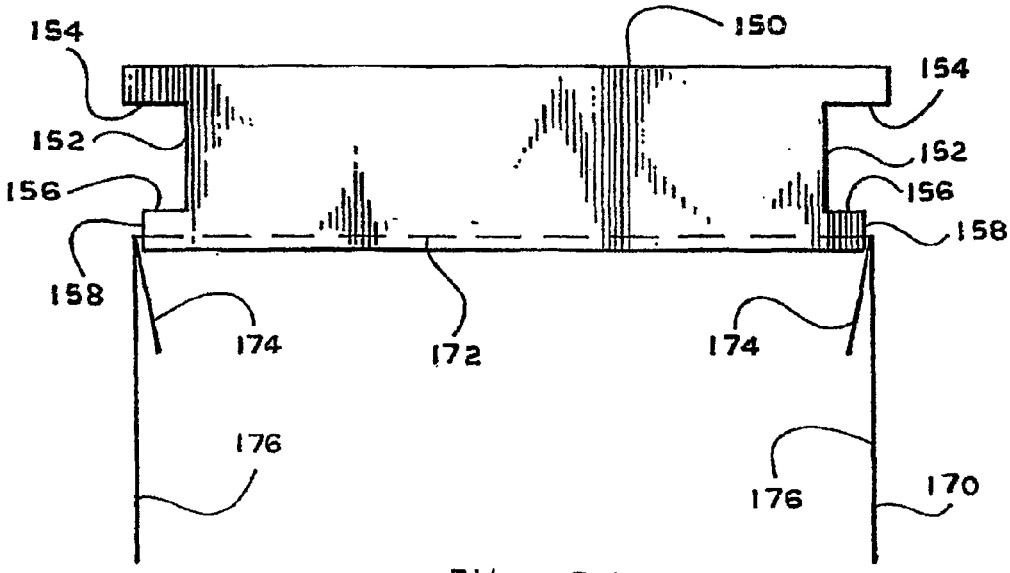
Figure 8C:
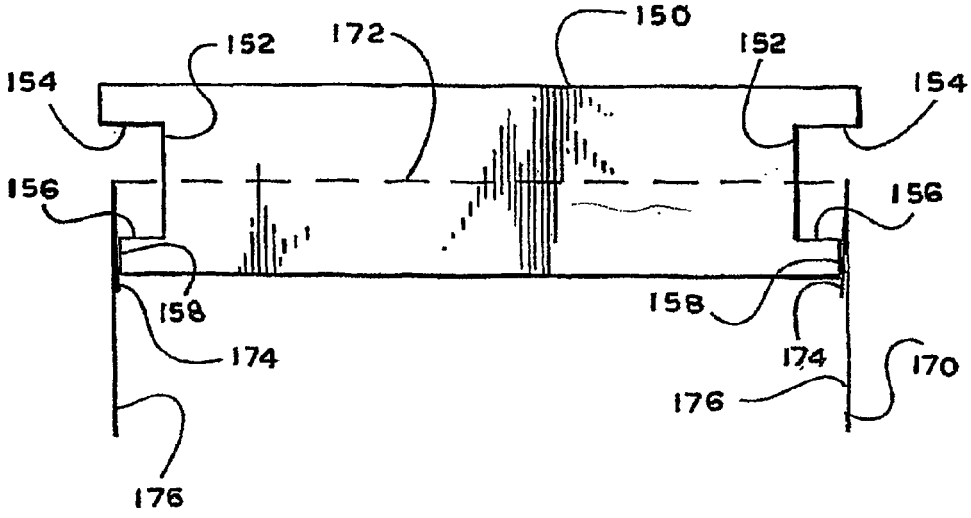
Figure 8D:
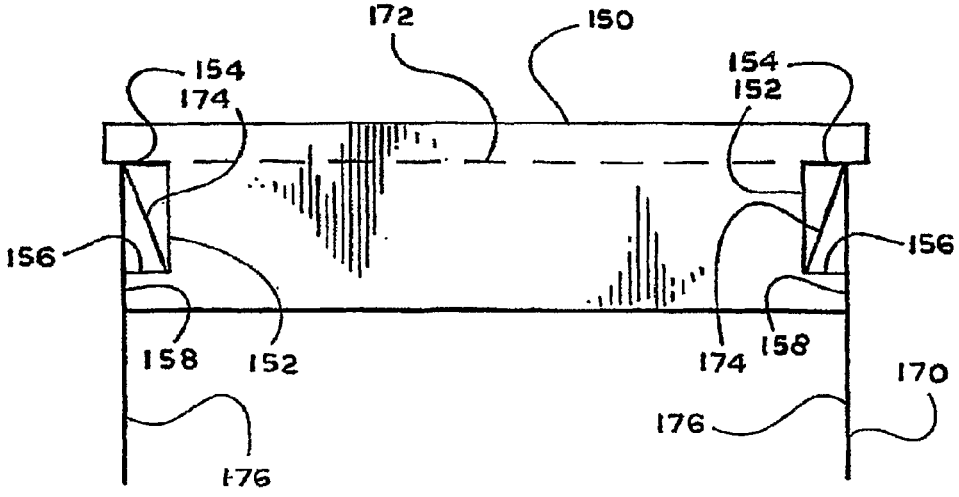

FIG. 8B shows the end cap 150 that has been partially inserted into the sleeve end 170. As shown in FIG. 8B, the bottom circumference of the end cap 150 urges the locking tabs 174 downward, towards the inner walls of the sleeve 176. In FIG. 8C, as the end cap 150 continues to be advanced downward, the locking tabs 174 are pressed against the inner walls of the sleeve 176. In FIG. 8D, when the end cap 150 reaches its final position, the locking tabs 174, because of their resiliency, tend to unfold slightly, causing the locking tabs 174 to open up into the channel 152. The slight unfolding of the locking tabs 174 causes the locking edges of the locking tabs 174 to engage the ledge surface 156, thereby preventing the end cap from being pulled upward out of the sleeve opening. Where the end caps have a convexly curved outer perimeter, the insertion of the end cap into the sleeve causes corresponding curves to form in the sleeve 176 and locking tabs 174. This curvature tends to increase the strength of the locking tabs 174.

Figure 9:
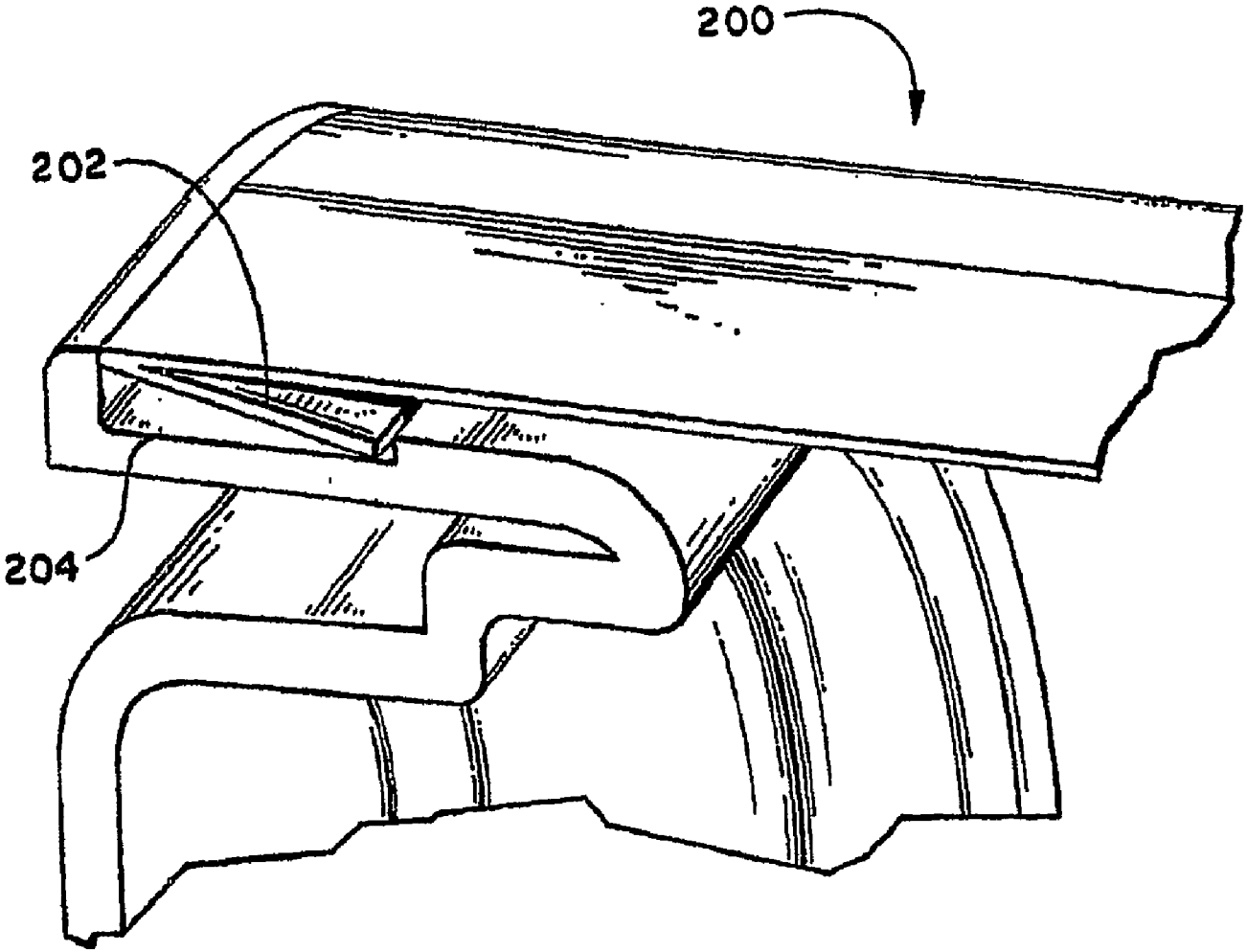
FIG. 9 provides a cutaway view of a sleeve and end cap illustrating the operation of an end cap retaining/locking mechanism according to a presently disclosed embodiment.

FIG. 9 shows a cutaway view of a package 200 according to a presently disclosed embodiment. FIG. 9 shows a close-up view of a portion of the package 200 illustrating a single locking tab 202 seated in a channel 204.

Figures 10A, 10B, 10C, 10D, 11A, 11B, 11C, 11D:
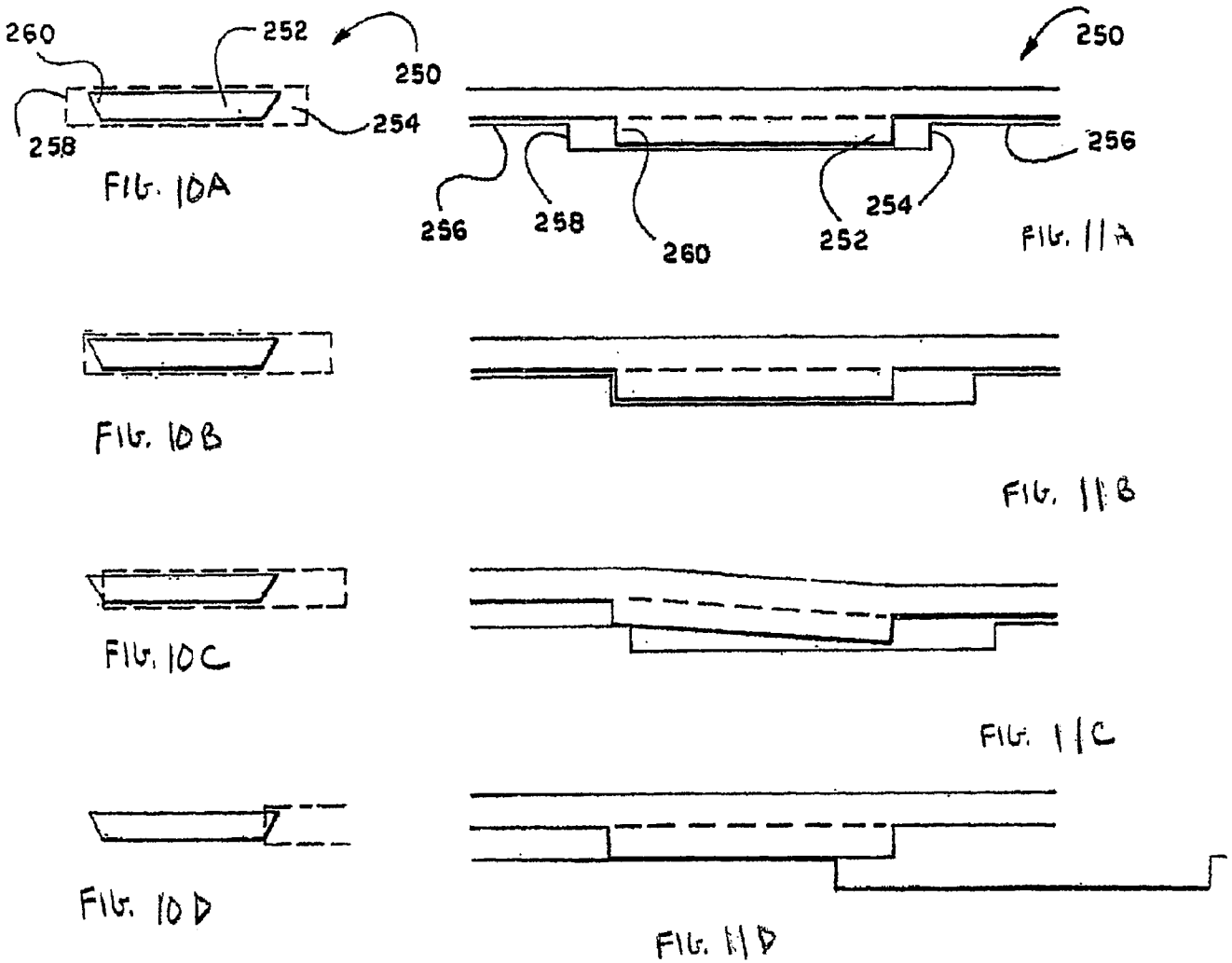
FIGS. 10A-10D and FIGS. 11A-11D show a series of diagrams illustrating the operation of a release mechanism according to a presently disclosed embodiment.

FIGS. 10A-D and 11A-D illustrate the operation of a release mechanism 250 according to a presently disclosed embodiment. FIG. 10A shows a diagram of a releasable locking tab 252 seated within a rectangular channel 254 in a finished package. As discussed above, the upper edge of the channel 254 is defined by the end cap rim, and the lower edge of the channel is defined by a ledge. The left and right edges of the channel are defined by surfaces 256 that are substantially continuous with the ledge face.

As described above, the releasable locking tab 252 has a trapezoidal shape. Thus, as the locking tab 252 is urged against a side edge 258 of the channel, it will be seen that an acute vertex 260 is presented to the side edge 258. The acute vertex 260 allows the locking tab 252 to ride up the side edge 258 of the channel 254 and onto surface 256, starting with the point of the vertex 260. The movement of the locking tab 252 onto surface 256 can be seen in FIGS. 11A-D.

Figure 12A:
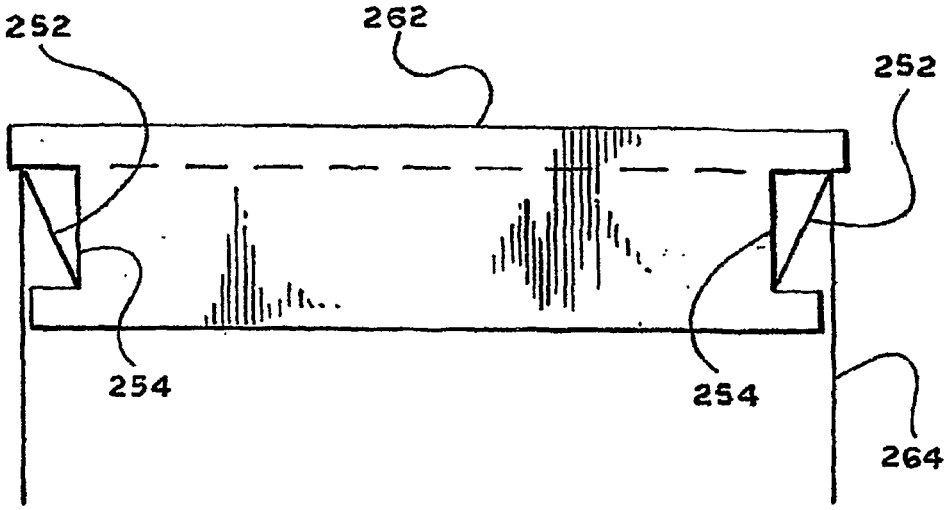
FIGS. 12A-12B show a series of diagrams illustrating the operation of a release mechanism illustrated in FIGS. 10A-10D and FIGS. 11A-11D.
Figure 12B:
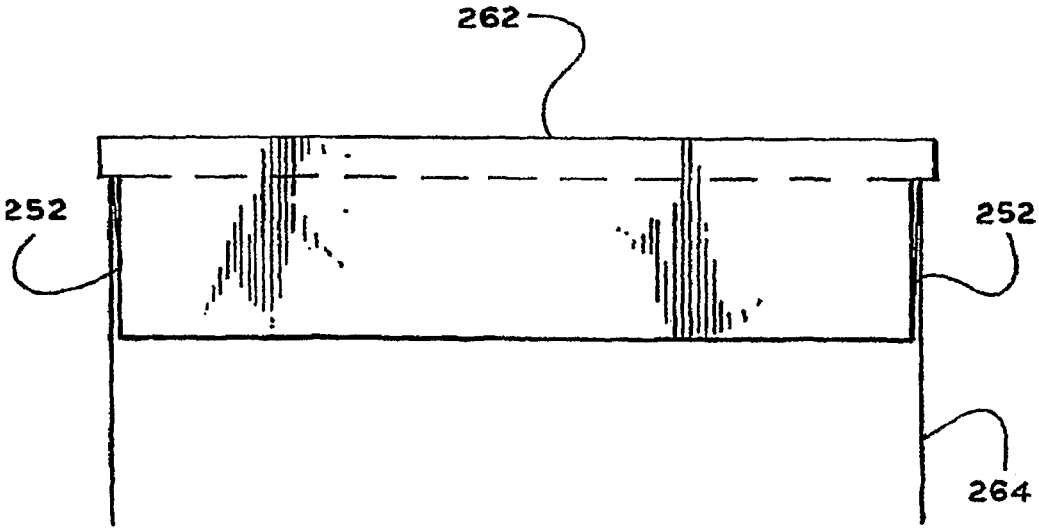
Figures 13A, 13B, 13C, 13D, 14A, 14B, 14C, 14D:
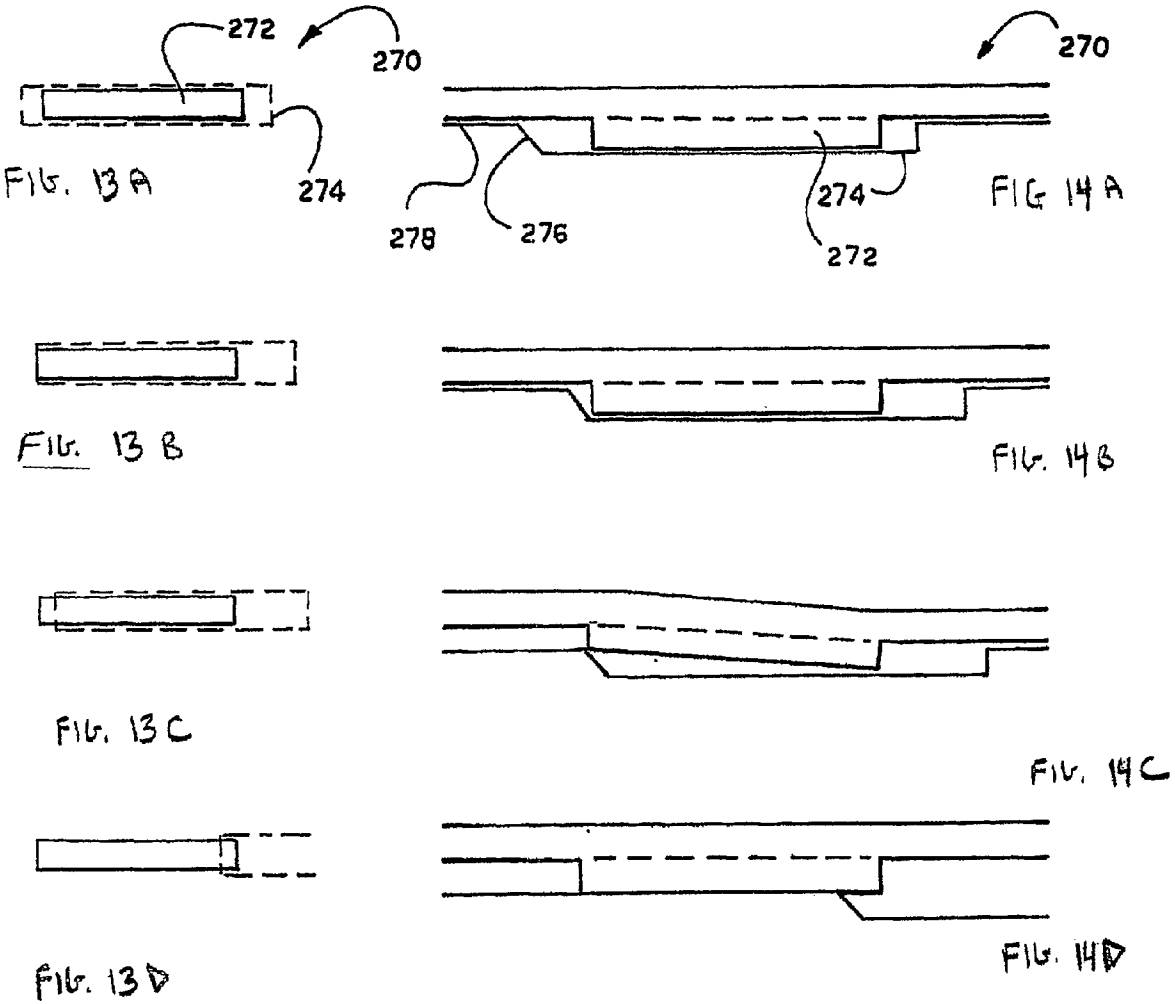
FIGS. 13A-13D and FIGS. 14A-14D show a series of diagrams illustrating the operation of a release mechanism according to a presently disclosed embodiment.

Because the sleeve is flexible and resilient, the end cap can be freely twisted within the sleeve opening, even when the end cap does not have a circular perimeter. Twisting the end cap causes a movement of the channel relative to the tab. As described above, this movement causes the locking tab to ride up onto a surface next to the channel, causing the locking tab to become disengaged from the channel and ledge. The disengagement of the locking mechanism is illustrated in FIGS. 12A and 12B. In FIG. 12A, each locking tab 252 is seated in a channel 254. In FIG. 12B, after the locking cap 262 has been twisted, the locking tabs 252 are no longer in the channels 254. The end cap can now be removed. The twist angle required to disengage the end cap 262 from the sleeve 264 can be adjusted by adjusting the dimensions of the channels 254, the locking tabs 252, or both.

It would be possible to create a one-way release mechanism, in which the end cap can be released only by twisting it in one direction. The one-way release mechanism could be accomplished, for example, by using a locking tab having a first side with an acute vertex, and a second side with square vertices. It would be difficult, if not impossible, to twist the end cap off in the direction of the square vertices.

FIGS. 13A-D and FIG. 14A-D illustrate an alternative release mechanism. According to a presently disclosed embodiment, a rectangular locking tab 272 may be used. As shown in FIGS. 14A-D, one side of the channel 274 is provided with a ramp 276 leading up to surface 278. When the end cap is twisted, the locking tab 272 rides up the ramp 276 and onto surface 278 to disengage the locking mechanism. In this example, only one ramp 276 is provided. Thus, the locking mechanism can only be released by twisting the end cap in the direction of the ramp 276. If desired, a second ramp can be added to the other side of the channel 274 to allow the locking mechanism to be released by twisting the end cap in either direction.

The use of a releasable locking cap may be desirable for a number of reasons. First, when the package is being loaded with product, the use of a releasable end cap allows a packaged item to be reworked without having to discard the package. Also, a customer may find a releasable end cap to be desirable. For example, a releasable end cap would allow the customer quick and easy access to the packaged item. Also, the customer may wish to replace the end cap for storage purposes, or for reusing the package.

It should be noted that it would be possible to use other configurations of locking tabs and channels without departing from the spirit of the invention. For example, it would be possible to use more than two locking tabs per opening. Also, different shapes may be used for the end caps and the sleeve.

All patents, patent applications, and published references cited herein are hereby incorporated by reference in their entirety. It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A product package, comprising:

a) a packaging sleeve having a first end defining an opening and a closed second end, the sleeve including at least one locking tab projecting from the first end, each of the at least one locking tab including a locking edge, each locking tab being folded inwards into the sleeve opening; and b) a product container which includes a body portion having an interior chamber for housing a product and a rigid end cap which sealingly engages with the body portion so as to seal the product within the interior chamber; wherein the end cap is dimensioned to fit closely within the opening of the sleeve and includes a peripheral rim that, when the end cap is inserted into the sleeve opening, engages the sleeve end and prevents the end cap from being inserted further into the opening, the end cap also including at least one channel for receiving the at least one locking tab, each channel having a ledge that engages the locking edge of each locking tab to prevent the end cap and product from being removed from the sleeve.

2. The product package as recited in claim 1, wherein each of the at least one locking tab is trapezoidal and has an acute vertex that rides up a side edge of the locking tab's receiving channel when the product end cap is twisted relative to the sleeve, such that the end cap is released from the sleeve.

3. The product package as recited in claim 1, wherein each of the at least one locking tab has at least one ramped side edge, such that when the end cap is twisted relative to the sleeve, each locking tab rides up the ramped side edge of the locking tab's receiving channel, such that the end cap is released from the sleeve.

4. The product package as recited in claim 1, wherein the second end of the sleeve includes a cavity shaped to receive an end of the product container.

5. The product package as recited in claim 1, wherein the product end cap includes means for releasably engaging with the body portion of the product container.

6. The product package as recited in claim 1, wherein the end cap includes a series of threads for engaging with corresponding threads formed on the body portion of the product container.

7. The product package as recited in claim 1, wherein the sleeve and locking tab have a strength and resilience that combines with the dimensioning and angling of the ledge to produce a firm locking action when the locking tab is engaged by the ledge, each of the at least one locking tab and the at least one channel being shaped such that the end cap is twistable to a position in which the locking tab is clear of the ledge, thereby releasing the end cap from the sleeve.

8. The product package as recited in claim 1, wherein the product container is adapted for storing toothpaste.

9. A product package, comprising:

a) a sleeve including at least one end defining an opening and at least one pair of locking tabs extending therefrom, each locking tab including a locking edge and being folded inwards into the sleeve opening; and b) a product which includes a body portion and an end cap which is engaged with the body portion; wherein the body portion of the product is adapted and configured for insertion into the sleeve and the end cap is dimensioned to fit closely within the sleeve opening, the end cap including a rim that, when the end cap is inserted into the opening, engages the sleeve end and prevents the end cap from being inserted further into the opening, the end cap also including a pair of channels for receiving the pair of locking tabs, each channel having a ledge that is dimensioned and angled to engage the locking edge of each locking tab to prevent the end cap from being removed from the sleeve opening.

10. The product package as recited in claim 9, wherein each of the locking tabs is trapezoidal and has an acute vertex that rides up a side edge of the locking tab's receiving channel when the product end cap is twisted relative to the sleeve, such that the product end cap is released from the sleeve.

11. The product package as recited in claim 9, wherein each of the channels has at least one ramped side edge, such that when the product end cap is twisted relative to the sleeve, each locking tab rides up the ramped side edge of the locking tab's receiving channel, such that the product end cap is released from the sleeve.

12. The product package as recited in claim 9, wherein the sleeve includes a second end defining a second opening, and wherein the package further comprises: a second pair of locking tabs extending from the second end and folded inward into the second opening, each of the second pair of locking tabs having a locking edge; a second end cap dimensioned to fit closely within the second opening, the second end cap including a rim that, when the second end cap is inserted into the second opening, engages the second sleeve end and prevents the second end cap from being inserted further into the second opening, the second end cap including a channel for receiving the second pair of locking tabs, the channel having a ledge that engages the locking edge of each of the second pair of locking tabs to prevent the second end cap from being removed from the second sleeve opening.

13. The product package as recited in claim 12, wherein the second end cap includes a cavity shaped to receive a second end of the product.

14. The product package as recited in claim 9, wherein the end cap further includes means for engaging with the body portion of the product.

15. The product package as recited in claim 9, wherein the end cap includes a series of threads for engaging with corresponding threads formed on the body portion of the product.

16. The product package as recited in claim 9, wherein the sleeve and locking tabs have a strength and resilience that combines with the dimensioning and angling of the ledges to produce a firm locking action when the locking tabs are engaged by the ledges, each of the locking tabs and the channels being shaped such that the end cap is twistable to a position in which the locking tabs are clear of the ledges, thereby releasing the end cap from the sleeve.

17. A product package comprising:

a) an elongated sleeve defining an opening at one end thereof, the opening defined by a peripheral edge, the sleeve including a pair of opposed resilient locking tabs extending from the peripheral edge of the opening for releasably engaging an end cap received within the opening; and b) a product container which includes a body portion having an interior chamber for housing a product and a rigid end cap which sealingly engages with the body portion so as to seal the product within the interior chamber; wherein the end cap is adapted and configured for reception within the opening of the sleeve, the end cap having a base portion dimensioned and configured to extend into the sleeve and a peripheral wall extending upwardly from the base portion and having an outwardly extending rim adapted to abut the peripheral edge of the opening to limit the extent to which the base portion can extend into the sleeve, wherein the opposed resilient locking tabs are dimensioned and configured to releasably engage the peripheral wall of the end cap to prevent removal of the end cap from the sleeve.

18. A product package as recited in claim 17, wherein the opposed resilient locking tabs are dimensioned and configured to releasably engage an exterior surface of the peripheral wall of the end cap.

19. A product package as recited in claim 17, wherein the opposed locking tabs are adapted and configured for folding into the sleeve to releasably engage the peripheral wall of the end cap of the product container.

20. A product package as recited in claim 17, wherein the sleeve is defined by opposed first and second curved panels.

21. A product package as recited in claim 20, wherein the first and second curved panels are connected to one another along lateral edges of the sleeve.

22. A product package as recited in claim 21, wherein the first and second curved panels are integrally joined to one another along a first lateral edge of the sleeve.

23. A product package as recited in claim 21, wherein the first and second curved panels are affixed to one another along a second lateral edge of the sleeve.

24. The product package as recited in claim 17, wherein the product end cap further includes means for engaging with the body portion of the product.

25. The product package as recited in claim 17, wherein the product end cap includes a series of threads for engaging with corresponding threads formed on the body portion of the product.

26. The product package as recited in claim 17, wherein the sleeve and locking tabs have a strength and resilience that combines with the dimensioning and angling of the ledges to produce a firm locking action when the locking tabs are engaged by the ledges, each of the locking tabs and the channels being shaped such that the end cap is twistable to a position in which the locking tabs are clear of the ledges, thereby releasing the product end cap from the sleeve.

27. A product package as recited in claim 17, wherein the sleeve defines a second opening at a second end thereof, the second opening defined by a second peripheral edge, and wherein the sleeve includes a second pair of opposed resilient locking tabs extending from the second peripheral edge of the second opening for releasably engaging a second end cap received within the second opening.

28. A product package as recited in claim 27, further comprising a second end cap adapted and configured for reception within the second opening of the sleeve.

29. A product package as recited in claim 28, wherein the second end cap has a base portion dimensioned to extend into the sleeve and a peripheral wall extending upwardly from the base portion and having an outwardly extending rim adapted to abut the peripheral edge of the second opening to limit the extent to which the base portion of the second end cap can extend into the sleeve.

30. A product package as recited in claim 29, wherein the second pair of opposed resilient locking tabs are dimensioned and configured to releasably engage the peripheral wall of the second end cap to prevent removal of the second end cap from the sleeve.

31. A product package as recited in claim 30, wherein the base portion of the second end cap includes a shaped cavity for accommodating an end of the product container displayed within the sleeve.

32. A product package as recited in claim 31, wherein the shaped cavity extends upwardly from the base portion of the second end cap.

33. A product package as recited in claim 32, wherein the shaped cavity extends upwardly from the base portion of the second end cap below the rim of the peripheral wall of the second end cap.

34. A product package as recited in claim 33, wherein the shaped cavity of the second end cap has a generally circular cross-section.

* * * * *